US010753563B2

(12) United States Patent
Motohashi

(10) Patent No.: US 10,753,563 B2
(45) Date of Patent: Aug. 25, 2020

(54) VEHICLE LAMP

(71) Applicant: KOITO MANUFACTURING CO., LTD., Tokyo (JP)

(72) Inventor: Kazuya Motohashi, Shizuoka (JP)

(73) Assignee: KOITO MANUFACTURING CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/278,877

(22) Filed: Feb. 19, 2019

(65) Prior Publication Data

US 2019/0257492 A1 Aug. 22, 2019

(30) Foreign Application Priority Data

Feb. 22, 2018 (JP) ..... 2018-029344

(51) Int. Cl.
*F21V 5/00* (2018.01)
*F21S 41/25* (2018.01)
*F21S 41/143* (2018.01)

(52) U.S. Cl.
CPC ..... *F21S 41/25* (2018.01); *F21S 41/143* (2018.01)

(58) Field of Classification Search
CPC ..... F21S 41/143; F21S 41/27; F21S 41/25
See application file for complete search history.

(56) References Cited

U.S. PATENT DOCUMENTS 5,541,692 A 7/1996 Ota
9,857,557 B1 * 1/2018 Bone ..... G02B 9/34
2016/0341384 A1 * 11/2016 Hoshino ..... F21S 45/70
2017/0002991 A1 1/2017 Yagi
2017/0138555 A1 * 5/2017 Hirasawa ..... B60Q 1/14

FOREIGN PATENT DOCUMENTS

JP 08-068935 A 3/1996
JP 2017-016928 A 1/2017

OTHER PUBLICATIONS

Wikipedia, "PMMA", 2007 via waybackmachine,https://en.wikipedia.org/wiki/Poly(methyl_methacrylate), Wikipedia (Year: 2007).*
Matthew Brennesholtz, Edward Stupp, "Projection Displays", 2008, John Wiley & Sons, pp. 131-132 (Year: 2008).*
Max 10, AVforums, "What projector's have glass lenses?", Oct. 6, 2017, https://www.avforums.com/threads/what-projectors-have-glass-lenses.2125888/ (Year: 2017).*
Wikipedia, "Cooke Triplet", https://en.m.wikipedia.org/wiki/Cooke_triplet, developed in 1893 (Year: 1893).*
"Thick Lens Formula", Weisstein, 2007, WolframResearch, http://scienceworld.wolfram.com/physics/ThickLensFormula.html (Year: 2007).*

* cited by examiner

*Primary Examiner* — Matthew J. Peerce
(74) *Attorney, Agent, or Firm* — Sughrue Mion, PLLC

(57) ABSTRACT

A vehicle lamp includes a light source, and a projection lens which is configured to project light emitted from the light source. The projection lens includes two or more resin lenses and one or more glass lenses, and a refractive power ratio R (=Pr/Pt) of a total refractive power Pr of the resin lenses to a refractive power Pt of the entire projection lens satisfies a relationship of R<⅓.

6 Claims, 9 Drawing Sheets

$$z(r) = \frac{cr^2}{1 + \sqrt{1 - (1+k)c^2r^2}} + \alpha_1 r^4 + \alpha_2 r^6 \quad \cdots (1)$$

Z: SAG AMOUNT r: HEIGHT IN A RADIAL DIRECTION OF LENS c: RADIUS OF CURVATURE k: CONIC CONSTANT α1, α2: ASPHERICAL COEFFICIENT

| SURFACE | RADIUS OF CURVATURE | THICKNESS | CONIC | α1 | α2 |
|---|---|---|---|---|---|
| S1 | 57.048 | 15.000 | 0.792 | 1.64E-07 | -5.03E-10 |
| S2 | -76.972 | 6.000 | -4.778 | -1.41E-06 | 1.82E-09 |
| S3 | -31.026 | 3.000 | -0.509 | 6.45E-06 | -2.13E-10 |
| S4 | 616.377 | 6.000 | 0.000 | 3.70E-06 | -3.05E-09 |
| S5 | 41.954 | 25.000 | -3.174 | 1.91E-06 | -4.13E-10 |
| S6 | -39.790 | 39.993 | -3.642 | 6.54E-07 | 4.65E-10 |

PROJECTION LENS 4

| TEMPERATURE (°C) | 0 | 20 | 40 | 80 |
|---|---|---|---|---|
| FOCAL LENGTH (mm) | 57.1 | 57 | 57 | 57 |
| RMS RADIUS (um) AT 0° | 21.6 | 12.4 | 8.6 | 25.5 |
| RMS RADIUS (um) AT 10° | 96.9 | 84.7 | 79.4 | 93.1 |
| SPOT SHAPE AT 0° |  |  |  |  |

COMPARATIVE EXAMPLE

| TEMPERATURE (°C) | 0 | 20 | 40 | 80 |
|---|---|---|---|---|
| FOCAL LENGTH (mm) | 56.7 | 57 | 57.3 | 58 |
| RMS RADIUS (um) AT 0° | 131.5 | 13.5 | 131.5 | 425.9 |
| RMS RADIUS (um) AT 10° | 166 | 78.8 | 165.7 | 405.1 |
| SPOT SHAPE AT 0° |  |  |  |  |

$$z(r) = \frac{cr^2}{1+\sqrt{1-(1+k)c^2r^2}} + \alpha_1 r^4 + \alpha_2 r^6 \quad \cdots (1)$$

Z: SAG AMOUNT r: HEIGHT IN A RADIAL DIRECTION OF LENS c: RADIUS OF CURVATURE k: CONIC CONSTANT α1, α2: ASPHERICAL COEFFICIENT

| SURFACE | RADIUS OF CURVATURE | THICKNESS | CONIC | α1 | α2 |
|---|---|---|---|---|---|
| S1 | 41.81 | 16.00 | 0.36 | -2.81E-07 | -9.21E-10 |
| S2 | -131.60 | 6.09 | -13.82 | -8.82E-08 | 1.20E-09 |
| S3 | -38.08 | 5.00 | -0.40 | 6.74E-06 | -9.86E-10 |
| S4 | 79.45 | 4.39 | 0.00 | 3.43E-07 | -1.50E-09 |
| S5 | 38.55 | 10.00 | -3.02 | 1.77E-06 | -2.19E-09 |
| S6 | 539.95 | 1.00 | 177.73 | -4.32E-08 | 1.24E-10 |
| S7 | 190.50 | 10.00 | -131.78 | 2.27E-07 | -3.57E-10 |
| S8 | -45.42 | 40.00 | -4.53 | 1.57E-07 | -8.76E-10 |

PROJECTION LENS 4A

| TEMPERATURE (°C) | 0 | 20 | 40 | 80 |
|---|---|---|---|---|
| FOCAL LENGTH (mm) | 57.1 | 57 | 57 | 57 |
| RMS RADIUS (um) AT 0° | 10.75 | 11.607 | 12.636 | 15.17 |
| RMS RADIUS (um) AT 10° | 86.558 | 75.35 | 70.022 | 80.3 |
| SPOT SHAPE AT 0° |  |  |  |  |

VEHICLE LAMP

CROSS-REFERENCE TO RELATED APPLICATIONS

The present application claims priority from Japanese Patent Application No. 2018-029344, filed Feb. 22, 2018, the entire content of which is incorporated herein by reference.

TECHNICAL FIELD

Aspects of the present invention relate to a lamp to be used in a vehicle such as an automobile, and in particular to a vehicle lamp suitable for a headlight (headlamp) capable of an Adaptive Driving Beam (ADB) light distribution control.

BACKGROUND ART

As a headlamp of an automobile, there has been proposed an ADB light distribution control as one method for obtaining a light distribution for preventing dazzling to a vehicle (hereinafter referred to as a "front vehicle") in a front region of an own vehicle, such as a preceding vehicle or an oncoming vehicle in the front region, while increasing an illumination effect of the front region of the own vehicle. The ADB light distribution control includes detecting a front vehicle by a vehicle position detection device, reducing or turning off a light amount in a region in which the detected front vehicle presents, while brightly illuminating other wide regions.

In recent years, the ADB light distribution control is also applied to a headlamp using a light emitting element such as an LED as a light source. Specifically, in the headlamp, light from a plurality of LEDs as light sources, that is, illumination region of respective LEDs are combined to form a light distribution for illuminating the front region of the own vehicle. Further, when a front vehicle is detected, LEDs in an illumination region corresponding to the detected front vehicle are dimmed or turned off.

In the ADB light distribution control, white light emitted from the plurality of LEDs is projected to the front region of the own vehicle by a projection lens to form a plurality of illumination regions, these illumination regions are combined and synthesized appropriately, and thus an appropriate illumination region is formed. However, a pattern shape of the light of the LEDs to be projected may vary due to aberration caused by the projection lens, which makes it difficult to perform the ADB light distribution control with high accuracy.

In JP-A-2017-16928, a rear main surface of the projection lens is designed to have a predetermined curvature, so that a direction of coma aberration is specified and uniformity of the light pattern to be projected is improved. However, since the technique of JP-A-2017-16928 does not cope with the aberration, this technique would not cope with change in pattern shape of the light caused by the aberration.

In order to cope with the aberration, it is considered to configure the projection lens with a plurality of lenses, for example, a triplet lens. In this case, in order to reduce the weight and cost of the projection lens, it is also considered to configure a part of the plurality of lenses with resin lenses. For example, JP-A-H8-68935 proposes, a technique in which in a camera including a triplet lens, a first lens and a second lens are formed of resin and a third lens is formed of glass.

Since the lens of JP-A-H8-68935 is applied to a camera which is often used at a so-called normal temperature (or room temperature), a problem caused by change in ambient temperature would rarely arise. However, a problem may arise when this type of lens is applied to a projection lens of a lamp of an automobile. That is, when applied to a projection lens of a lamp of an automobile, since an ambient temperature varies in a range of 0° C. to 80° C. while the lamp is turned on and turned off, change of optical characteristics of the triplet lens due to change of thermal expansion of the lens formed of resin, in particular a spot shape due to spherical aberration is noticeable. When the spot shape formed by the projection lens changes with the temperature change, the pattern shape of the illumination region to be projected also changes, and therefore, the reliability of the ADB light distribution control may deteriorate with the temperature change.

SUMMARY

Accordingly, an aspect of the present invention provides a vehicle lamp including a projection lens which reduces a shape change of a light distribution pattern with temperature change, that is, temperature dependence of a spot shape which represents an imaging performance of the projection lens.

According to an embodiment of the present invention, there is provided a vehicle lamp including a light source; and a projection lens which is configured to project light emitted from the light source. The projection lens includes two or more resin lenses and one or more glass lenses, and a refractive power ratio R (=Pr/Pt) of a total refractive power Pr of the resin lenses to a refractive power Pt of the entire projection lens satisfies a relationship of $R<1/3$.

The projection lens may be configured by a triplet lens including a first lens having a positive refractive power, a second lens having a negative refractive power, and a third lens having a positive refractive power in order from a side opposite to a light source, the first and second lenses are formed of resin, and the third lens is formed of glass.

According to the above configuration, since two or more lenses among the plurality of lenses configuring the projection lens are formed of resin, the weight of the projection lens can be reduced. Since the ratio of the refractive power of the resin lenses to the refractive power of the entire projection lens is smaller than ⅓, the temperature dependence of the spot shape which represents the imaging performance of the projection lens can be improved and the suitable ADB light distribution control can be realized.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION OF EMBODIMENTS

Figure 1:
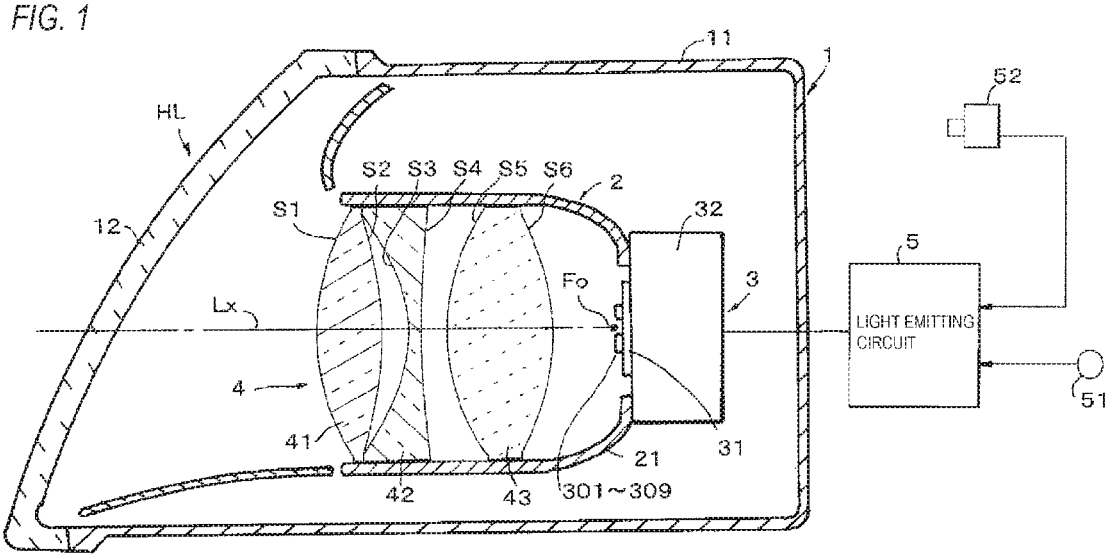
FIG. 1 is a schematic longitudinal sectional view of a headlamp including a light distribution control device according to an embodiment of the present invention.

Next, embodiments of the present invention will be described with reference to the drawings. FIG. 1 is a schematic longitudinal sectional view of a headlamp HL of an automobile to which can perform an ADB light distribution control. In the following description, a light source side in the headlamp HL is referred to as a rear, and a front side of the headlamp HL is referred to as a front.

In the head lamp HL, a lamp unit 2 is provided in a lamp housing 1 formed by a lamp body 11 and a front cover 12 formed of a light-transmitting material. The lamp unit 2 includes a light source 3 and a projection lens 4 provided and supported in a unit casing 21 whose inner surface is formed as a light reflecting surface. Light emitted from the light source 3 is irradiated to a front region of the automobile by the projection lens 4 so as to obtain a desired light distribution.

Figure 2:
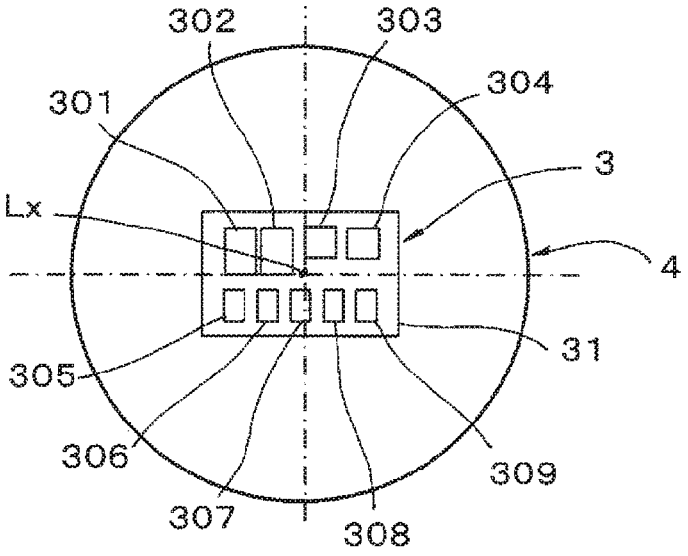
FIG. 2 is a schematic perspective view showing a lamp unit as viewed from the front.

FIG. 2 is a schematic perspective view showing the projection lens 4 when viewed from the front. As also shown in FIG. 1, in the light source 3, a plurality of light emitting elements 30, here, nine light emitting diode (LED) chips 301 to 309 which emit white light are mounted on a substrate 31 supported by a heat sink 32. These LED chips 301 to 309 are arranged in two stages, upper and lower stages, that is, four LED chips 301 to 304 are mounted in the upper stage and five LED chips 305 to 309 are mounted on the lower stage to be arranged in a horizontal direction. When the LED chips 301 to 309 emit light, the light emitted from the LED chips 301 to 309 are reflected directly or reflected by the inner surface of the unit casing 21 to the projection lens 4.

As shown in FIG. 1, the LED chips 301 to 309 are connected to a light emitting circuit 5 through the substrate 31 and are controlled such that on and off, and further a luminous intensity can be individually changed by the light emitting circuit 5. A lamp switch 51 to be operated by a driver is connected to the light emitting circuit 5, and a low beam light distribution, a high beam light distribution, an ADB light distribution can be switched and set by the lamp switch 51. The light emitting circuit 5 is connected to an in-vehicle camera 52 for performing the ADB control. A front vehicle is detected from a front image of the automobile taken by the in-vehicle camera 52, and a light distribution control is performed so as not to cause dazzling to the front vehicle.

Figure 3:
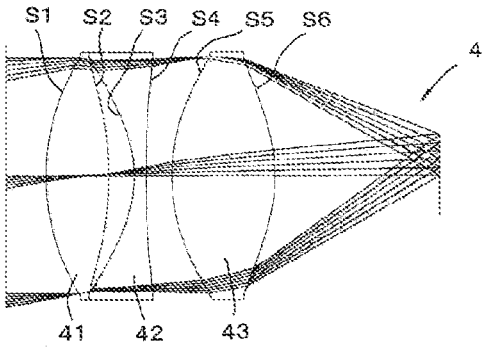
FIG. 3 is a diagram showing a surface configuration of first to third lenses configuring a projection lens of a first embodiment, and a design formula and design values thereof.

As shown in FIG. 3, in a first embodiment, the projection lens 4 is configured by a triplet lens and includes a first lens 41 which is a convex lens having a positive refractive power, a second lens 42 which is a concave lens having a negative refractive power, and a third lens 43 which is a convex lens having a positive refractive power in order from a lamp front side. The first lens 41 to the third lens 43 are arranged coaxially with optical axes thereof aligned with each other, and the light source 3, that is, the LED chips 301 to 309 are arranged in the vicinity of a focal point Fo on a lamp rear side of the projection lens 4.

Among the three lenses configuring the projection lens 4, the first lens 41 and the second lens 42 are formed of light-transmitting resin, for example, the first lens is formed of PMMA (acrylic resin), and the second lens 42 is formed of PC (polycarbonate resin). The third lens 43 is formed of light-transmitting glass having a refractive index and dispersion (high Abbe number) lower than those of the second lens 42, for example, N-BK7 (borosilicate crown glass).

In order to reduce aberrations in the projection lens 4, that is, chromatic aberration, spherical aberration, astigmatism, and coma aberration, among a front surface (first surface) S1 and a rear surface (second surface) S2 of the first lens 41, a front surface (third surface) S3 and a rear surface (fourth surface) S4 of the second lens 42, and a front surface (fifth surface) S5 and a rear surface (sixth surface) S6 of the third lens 43, at least the first surface S1 to the fifth surface S5 are designed as aspherical surfaces. In this embodiment, the first surface S1 to the sixth surface S6 are all designed to be aspherical surfaces based on an aspherical definition formula (1) shown in FIG. 3. Here, z is a sag amount, r is a radial dimension from an optical axis, c is a radius of curvature, k is a conic constant, and $\alpha 1$ and $\alpha 2$ are aspherical coefficients.

Figure 4:
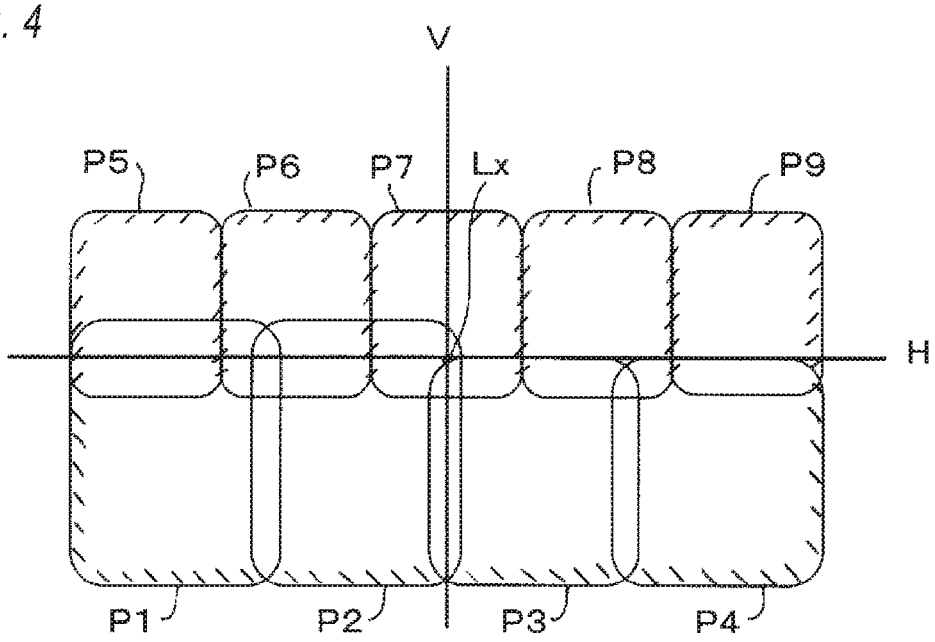
FIG. 4 is a diagram of a light distribution pattern obtained by combining light emitted from LED chips.

In the headlamp HL of the first embodiment including the projection lens 4 having the above configuration, the low beam light distribution control or the high beam light distribution control is set by switching the lamp switch 51 by a driver or the like. In the low beam light distribution control, the four LED chips 301 to 304 in the upper stage emit light under the control of the light emitting circuit 5. The white light emitted from the LED chips 301 to 304 is irradiated to a front region of the automobile by the projection lens 4, and in FIG. 4, a light distribution in which illumination regions P1 to P4 are combined, that is, the low beam light distribution is formed in which a region lower than a cutoff line substantially along a horizontal line H passing through a lens optical axis Lx is illuminated.

In the high beam light distribution control, the five LED chips 305 to 309 on the lower stage emit light under the control of the light emitting circuit 5. The white light of the LED chips 305 to 309 is irradiated to a front region of the automobile by the projection lens 4, and the light distribution is formed in which illumination regions P5 to P9 are combined. The light distribution is combined with the above-described low beam light distribution P1 to P4, and the high beam light distribution for illuminating a wide region is formed.

Meanwhile, when the ADB light distribution control is set by the driver, the light emitting circuit 5 controls the high beam light distribution in principle, and a front vehicle in the front region of the automobile is detected based on the image taken by the in-vehicle camera 52. Further, light of the LED chips corresponding to an illumination region overlapping the detected front vehicle, in particular a region overlapping the illumination regions P5 to P9 is dimmed or turned off. Thus, the illumination region to which the front vehicle belongs is selectively shielded from light so as to prevent dazzling caused to the front vehicle, while the ADB light distribution with enhanced visibility in other illumination regions is performed.

Further, in the projection lens 4 of the first embodiment, a specific gravity of the resin configuring the first lens 41 and the second lens 42, here, a specific gravity of PMMA and PC is approximately 1.2 ($g/cm^{-3}$), which is approximately ½ of a specific gravity (2.0 ($g/cm^{-3}$)) of the glass of the third lens. Therefore, weight of the projection lens 4 can be reduced as compared with a projection lens in which the first lens 41 and the second lens 42 are formed of glass. Further, the cost can be reduced. The reason why the third lens 43 is formed of glass is to improve the imaging performance of the projection lens 4 as described later.

Here, considering ambient temperature of the projection lens 4, when the headlamp HL is turned off, a temperature of the projection lens 4 is substantially equal to a temperature of external air, which is approximately 0° C. to 40° C. Meanwhile, when the headlamp HL is turned on, the temperature of the projection lens 4 is raised to about 80° C. due to heat generated in the LED chips 301 to 309.

In the projection lens 4 of the embodiment, a thermal expansion coefficient of PMMA of the first lens 41 is about $4.7\times10^{-5}$/° C. to $7\times10^{-5}$/° C., and a thermal expansion coefficient of PC of the second lens 42 is about $5.6\times10^{-5}$/° C. A thermal expansion coefficient of N-BK7 of the third lens 43 is about $30\times10^{-7}$/° C. Therefore, when the first lens 41 and the second lens 42 are deformed due to thermal expansion, the lens refractive power of the first lens 41 and the second lens 42 changes, and there is a problem in aberration in the projection lens 4. Meanwhile, since the third lens 43 is formed of glass and has a thermal expansion coefficient about two orders of magnitude smaller than that of resin, influence to the refractive power by the temperature change of the projection lens 4 can be neglected.

Therefore, the inventor of the present application considered the influence of the change in refractive power of the first lens 41 and the second lens 42 formed of resin on the imaging performance of the projection lens 4. In particular, a correlation between a ratio of a total refractive power of the first lens 41 and the second lens 42 to a refractive power of the entire projection lens 4, and the imaging performance of the projection lens 4 was examined. That is, a refractive power ratio R of a total refractive power $P_{1,2}$ of the first lens 41 and the second lens 42 to a refractive power Pt of the entire projection lens 4 was calculated, and temperature dependence of the refractive power ratio R ($=P_{1,2}/Pt$) and the imaging performance in the projection lens 4 was investigated.

When the positive refractive power of the first lens 41 was set to (+P1) and the negative refractive power of the second lens 42 was set to (−P2), the total refractive power $P_{1,2}$ of the first lens 41 and the second lens 42 is $P_{1,2}$=P1−P2. When a focal length of the first lens 41 is set to (+f1) and a focal length of the second lens 42 is set to (−f2), the refractive power P1 of the first lens 41 is (+1/f1), and the refractive power P2 of the second lens 42 is (−1/f2), so that the total refractive power $P_{1,2}$ is calculated as $P_{1,2}$=(1/f1)−(1/f2).

When the positive refractive power of the third lens 43 is set to (+P3), the refractive power Pt of the entire projection lens 4 is Pt=P1−P2+P3. That is, when the focal length of the third lens 43 is set to (+f3), Pt=(1/f1)−(1/f2)+(1/f3).

Figure 5:
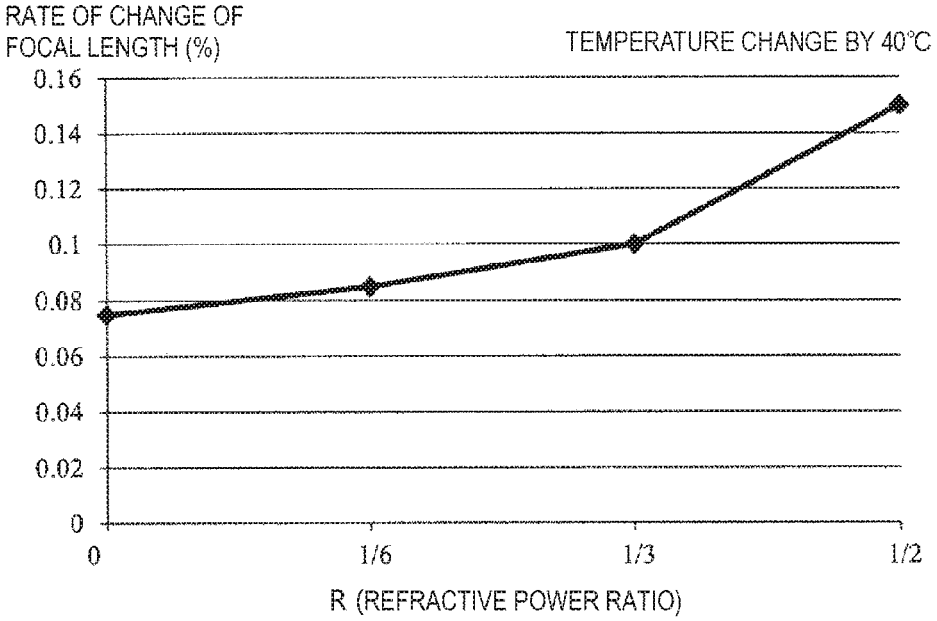
FIG. 5 is a graph showing temperature dependence of a refractive power ratio and a rate of change of focal length.

Further, in order to evaluate the temperature dependence of the imaging performance of the projection lens 4 when the refractive power ratio R is changed, the rate of change of focal length closely related to the aberration was measured. The results are shown in FIG. 5. The abscissa is the refractive power ratio R, and the ordinate is the rate (%) of change of focal length. For the projection lens designed such that the refractive power ratio R is ⅙, ⅓, and ½, the rate of change of focal length when the temperature is changed by 40° C. was measured. As a result, it is found that the rate of change increases as the refractive power ratio R increases, but in order to set the rate of change of focal length which substantially influences the spot shape as the imaging performance to 0.1(%) or less, the refractive power ratio R is preferably set to satisfy R<⅓.

Therefore, in the first embodiment, the refractive power ratio R of the total refractive powers $P_{1,2}$ of the first lens 41 and the second lens 42 to the refractive power Pt of the entire projection lens 4 is designed to satisfy R<⅓. That is, $R=(P_{1,2}/Pt)<⅓$.

In order to realize the above relationship, in the projection lens 4 of the first embodiment, the shapes of the first lens 41 and the second lens 42 which are formed of resin, that is, the first surface S1 to the fourth surface S4 are designed as aspherical surfaces as shown in FIG. 3, and the focal length of the first lens 41 and the focal length of the second lens 42 are substantially equal to each other. Thus, since the focal length f1 of the first lens 41 and the focal length f2 of the second lens 42 are substantially equal to each other, the total refractive power $P_{1,2}$ has a small value close to "0". Therefore, the total refractive powers $P_{1,2}$ of the first lens 41 and the second lens 42 can be extremely small relative to the refractive power Pt of the entire projection lens 4, and it is easy to design the refractive power ratio R to be smaller than ⅓.

In the projection lens 4 of the first embodiment, the thermal expansion coefficients of each resin configuring the first lens 41 and the second lens 42 are substantially equal to each other. Therefore, the refractive powers of the first lens and the second lens change in opposite directions according to the temperature change, and the total refractive power $P_{1,2}$ is not changed so much even by the temperature change. Thus, the refractive power ratio R is easily maintained at a value smaller than ⅓.

Even if the type of resin configuring the first lens 41 and the second lens 42 is different and the thermal expansion coefficients of the resin are different to some degree, the thermal expansion coefficient of the resin is naturally very large as compared with the thermal expansion coefficient of the glass, so that a difference in the thermal expansion coefficient can be neglected. Therefore, the above-described effect of improving the temperature dependence can be obtained even in this case. If the first lens 41 and the second lens 42 are formed of resin having the same thermal expansion coefficient, the temperature dependence can be further improved.

Figure 6A:
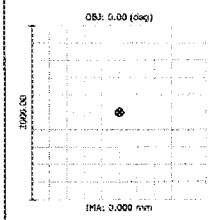
FIG. 6A is a simulation diagram showing change in spot shape due to temperature change of the projection lens of the first embodiment.
Figure 6A:
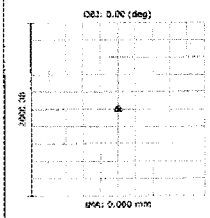
Figure 6A:
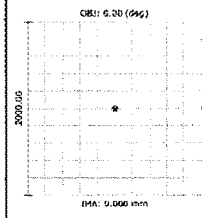
Figure 6A:
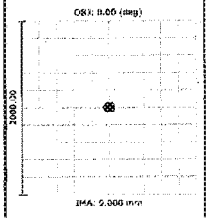

FIG. 6A shows the spot shape as the imaging performance of the projection lens 4 of the first embodiment simulated by the inventor. In the projection lens 4 of the first embodiment shown in FIG. 3, the first lens 41 and the second lens 42 are formed of resin and the third lens 43 is formed of glass. The total refractive power of the first lens 41 and the second lens 42 is set to a small value close to "0", and the refractive power ratio R is designed to satisfy the condition of R<⅓.

Figure 6B:
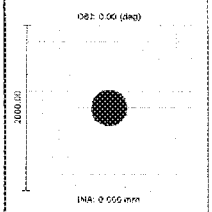
FIG. 6B is a simulation diagram showing change in spot shape due to temperature change of a projection lens of a comparative example.
Figure 6B:
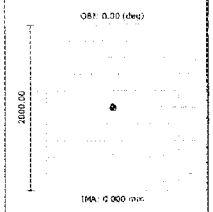
Figure 6B:
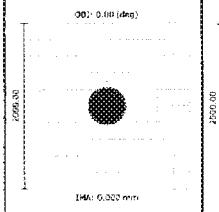
Figure 6B:
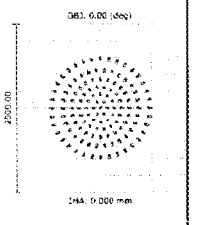

FIG. 6B is a simulation diagram of a projection lens as a comparative example in which the first lens 41 to the third lens 43 are all formed of resin although having similar lens configuration with the projection lens 4 of the first embodiment. Deformation due to thermal expansion is significant in all of the first lens to the third lens, and the refractive power ratio R does not satisfy the condition of R<⅓.

Light beams of a required diameter enters, from the first lens 41 side to the projection lens 4 of this embodiment and the projection lens of the comparative example to form a spot. Further, all focal lengths, Root Mean Square (RMS) radii, and change of spot shape when the temperature of the projection lens changes to 0° C., 20° C., 40° C. and 80° C. are obtained. The RMS radii, when an angle with respect to the optical axis is 0° and 10°, are obtained. When comparing the change of focal length, the change of spot shape, and the RMS radius value at each temperature, it is determined the temperature dependence of the spot shape of the projection lens of the embodiment in FIG. 6A is smaller than that of the projection lens of the comparative example of FIG. 6B.

The refractive power Pt of the entire projection lens 4 of the first embodiment shown in FIG. 6A is 0.175, and the total refractive power $P_{1,2}$ of the first lens 41 and the second lens 42 is 0.002. Therefore, the refractive power ratio R is approximately 1/80, which satisfies the above condition of R<1/3. In a case where the refractive power ratio R is 1/80, as can be seen from FIG. 5, the rate of change of focal length can be improved to 0.08(%) or less.

A range of the value of the refractive power ratio R corresponds a case where the rate of change of focal length is set to 0.1(%) or less as described above, and the value of the refractive power ratio R is set to a smaller range in a case where the rate of change of focal length is stricter. On the contrary, in a case where the rate of change of focal length may be relaxed, it goes without saying that the value of the refractive power ratio R may be set to a larger range. For example, in a further stricter case, as can be seen from FIG. 5, if the refractive power ratio R is set to satisfy R<1/6, the rate of change of focal length can be improved to be close to 0.08(%).

In the first embodiment, an example in which the first to sixth surfaces are all designed as aspherical surfaces has been described, but in the present invention, it suffices that at least the first surface to the fifth surface are aspherical surfaces, and the sixth surface may be a spherical surface. The present invention can also be applied to a case where the convex lenses of the first lens and the third lens and the concave lens of the second lens are meniscus lenses whose both surfaces are curved in the same direction.

Figure 7:
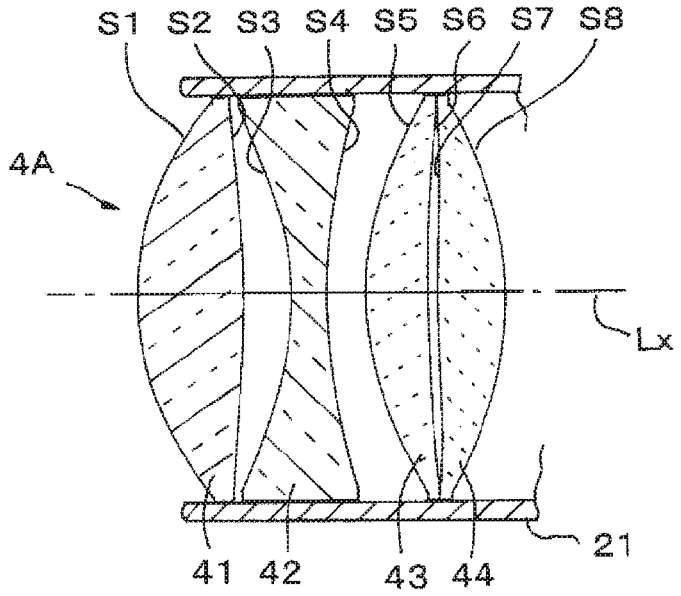
FIG. 7 is a configuration diagram of a projection lens according to a second embodiment.

FIG. 7 is a diagram of a lens configuration of a projection lens 4A of a second embodiment. In the second embodiment, the projection lens is configured by four lenses. That is, the projection lens is configured by a first lens 41 which is a convex lens having a positive refractive power, a second lens 42 which is a concave lens having a negative refractive power, and a third lens 43 and a fourth lens 44 each of which is a convex lens having a positive refractive power, in order from a lamp front side. Surfaces S1 to S6 are similar to those in the first embodiment, and surfaces S7 and S8 represent a front surface and a rear surface of the fourth lens 44.

Figure 8:
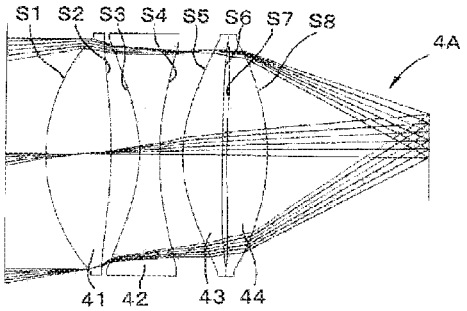
FIG. 8 is a diagram showing a surface configuration of first to fourth lenses configuring the projection lens of the second embodiment, and a design formula and design values thereof.

FIG. 8 is a diagram showing the surface configuration of the projection lens 4A of the second embodiment, and a design formula and design values thereof. In the projection lens 4A, the first and second lenses 41, 42 are formed of resin, and the third and fourth lenses 43, 44 are formed of glass. Further, in the second embodiment, a refractive power ratio R of a total refractive power $P_{1,2}$ of the first lens 41 and the second lens 42 to a refractive power Pt of the entire projection lens 4A including the first lens 41 to the fourth lens 44 is designed to be 1/6. That is, R (=1/6)<1/3, which satisfies the condition described in the first embodiment, $R=(P_{1,2}/Pt)<1/3$.

In the projection lens 4A of the second embodiment, the temperature dependence of the imaging performance, when the refractive power ratio R was varied, was evaluated, and the result same as the first embodiment shown in FIG. 5 was obtained. Accordingly, it was found that it is also preferable to set the refractive power ratio R to satisfy R<1/3 in order to set the rate of change of focal length to be 0.1(%) or less in the projection lens 4A of the second embodiment.

Figure 9:
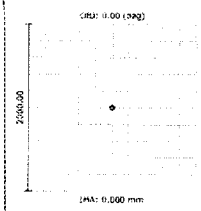
FIG. 9 is a simulation diagram showing change in spot shape due to temperature change of the projection lens of the second embodiment.
Figure 9:
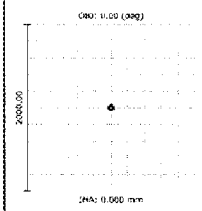
Figure 9:
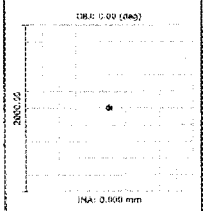
Figure 9:
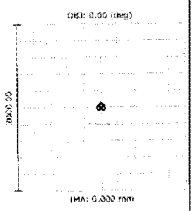

FIG. 9 is a simulation diagram showing change in spot shape due to temperature change of the projection lens 4A of the second embodiment. It was found that the temperature dependence of the spot shape is also small in the projection lens similarly to the projection lens of the first embodiment shown in FIG. 6A.

According to the examination of the inventor, if a projection lens includes two or more resin lenses and one or more glass lenses, and a refractive power ratio R (=Pr/Pt) of a total refractive power Pr of the resin lenses and a refractive power of the entire projection lens 4 including the resin lenses and the glass lenses satisfies a condition of R<1/3, a similar operational effect to the first and second embodiments can be obtained.

Here, in the headlamp of the embodiments, an example in which the light source includes nine LED chips to form the ADB light distribution is shown. However, it is not limited to the ADB light distribution and the number of LED chips, the number of illumination regions, and further a pattern shape of each illumination region may be arbitrarily set. The inventive concept of the present invention may also be applied to a lamp using micro electro mechanical systems (MEMS) mirror array as a light source. Also, the inventive concept of the present invention may be applied not only to an optical system which directly projects light of the light source but also to a lamp using an optical scanning optical system by reflected light of a rotating mirror and a swinging mirror.

The invention claimed is:

1. A vehicle lamp comprising:

a light source; and a projection lens configured to project light emitted from the light source, wherein the projection lens includes two or more resin lenses and one or more glass lenses, and a refractive power ratio R (=Pr/Pt) of a total refractive power Pr of the resin lenses to a refractive power Pt of the entire projection lens satisfies a relationship of R<1/3, wherein the projection lens is a triplet lens including a first lens having a positive refractive power, a second lens having a negative refractive power, and a third lens having a positive refractive power, in an order from a side opposite to the light source, the first lens and second lens are formed of resin, and the third lens is formed of glass.

2. The vehicle lamp according to claim 1, wherein the first lens and the second lens are formed of resin having substantially the same thermal expansion coefficient.

3. The vehicle lamp according to claim 1, wherein light from the light source is projected and an ADB light distribution control is performed.

4. A vehicle lamp comprising:

a light source; and a projection lens configured to project light emitted from the light source, wherein the projection lens includes two or more resin lenses and one or more glass lenses, and a refractive power ratio R (=Pr/Pt) of a total refractive power Pr of the resin lenses to a refractive power Pt of the entire projection lens satisfies a relationship of R<1/3, and wherein the projection lens includes a first lens having a positive refractive power, a second lens having a negative refractive power, a third lens having a positive refractive power, and a fourth lens having a positive refractive power in an order from a side opposite to the light source, the first lens and the second lens are formed of resin, and the third lens and the fourth lens are formed of glass.

5. The vehicle lamp according to claim 4, wherein the first lens and the second lens are formed of resin having substantially the same thermal expansion coefficient.

6. The vehicle lamp according to claim 4, wherein light from the light source is projected and an ADB light distribution control is performed.

* * * * *